United States Patent [19]

Lou

[11] 4,421,973

[45] Dec. 20, 1983

[54] ELECTRIC TOOTH PASTE TUBE WARMER

[76] Inventor: Kwong-Li Lou, 2400 W. Alhambra Rd., Alhambra, Calif. 91801

[21] Appl. No.: 264,675

[22] Filed: May 18, 1981

[51] Int. Cl.[3] ..... B67D 5/62; B05B 1/24; H05B 3/00

[52] U.S. Cl. ..... 219/301; 219/214; 222/146 HA; 222/146 HE; 239/133; 239/135

[58] Field of Search ..... 219/301, 214; 222/146 HE, 146 HA; 239/133-136

[56] References Cited

U.S. PATENT DOCUMENTS

| | | | |
|---|---|---|---|
| 3,116,403 | 12/1963 | Carter | 222/146 HA |
| 3,257,922 | 9/1970 | Reich et al. | 222/146 HA |
| 3,308,993 | 3/1967 | Bruno | 219/214 |
| 3,446,402 | 5/1969 | Gasser et al. | 219/214 X |

*Primary Examiner*—A. Bartis
*Attorney, Agent, or Firm*—Christie, Parker & Hale

[57] ABSTRACT

An apparatus for prewarming tooth paste in a tooth paste tube prior to extrusion from the tube through an outlet opening in the end of the tube includes a cap-shaped member of plastic material detachably closing the opening and enveloping the outlet end of the tooth paste tube. The cap-shaped member has an outer skirt portion extending along and surrounding portion of the side wall of the tube adjacent the outlet opening and an electrical resistance heating element is embedded in the cap-shaped member including the outer skirt thereof for warming the outlet section of the tube when the terminals of the heating element are connected to an electrical power source while the tube is closed by the cap-shaped member. A thermostat unit embedded in the cap-shaped member is connected in series with the heating element to control the temperature to which the outlet section of the tube is heated. The electrical terminals are formed in a rigid electrical plug at a stiff area on the cap-shaped member for direct insertion into an electric wall socket as well as for hanging the apparatus thereby.

4 Claims, 4 Drawing Figures

ELECTRIC TOOTH PASTE TUBE WARMER

BACKGROUND OF THE INVENTION

1. Field of the Invention

The present invention relates generally to a tooth paste tube warmer.

2. Description of the Prior Art

At present tooth paste is packaged in a tube which is either made of metal or plastic with one end closed and the other open for an outlet. The open end is covered by a screw-threaded cap when not in use. It is popularly experienced that during cold days, the extruded tooth paste is cold while the teeth in the mouth are warm. To brush the warm teeth with the cold tooth paste is quite uncomfortable and is unbearable to a lot of people.

SUMMARY OF THE INVENTION

It is therefore one object of the present invention to provide a heating device to warm up the outlet end of a tooth paste tube through which the tooth paste is to be extruded for brushing teeth.

The object of the present invention is achieved by a cap-shaped warmer having an electrical heating element and a thermostat unit at the interior with electrical terminals at the exterior. The cap-shaped warmer has detachable means for holding and enclosing the outlet section of the tooth paste tube.

The object of the present invention is also achieved by a tooth paste tube having an electrical heating element, a thermostat unit around the interior or exterior of its outlet section, and electrical terminals at the outside.

Moreover, said electrical heating element in the cap-shaped warmer can be an electrical resistance wire.

Furthermore, on both the cap-shaped warmer and the tooth paste tube, said electrical terminals are rigidly installed at a rigid portion forming an electrical plug.

BRIEF DESCRIPTION OF THE DRAWINGS

For a more complete understanding of the invention, reference should be made to the accompanying drawing, wherein.

DETAILED DESCRIPTION OF THE PREFERRED EMBODIMENTS

Figure 1:
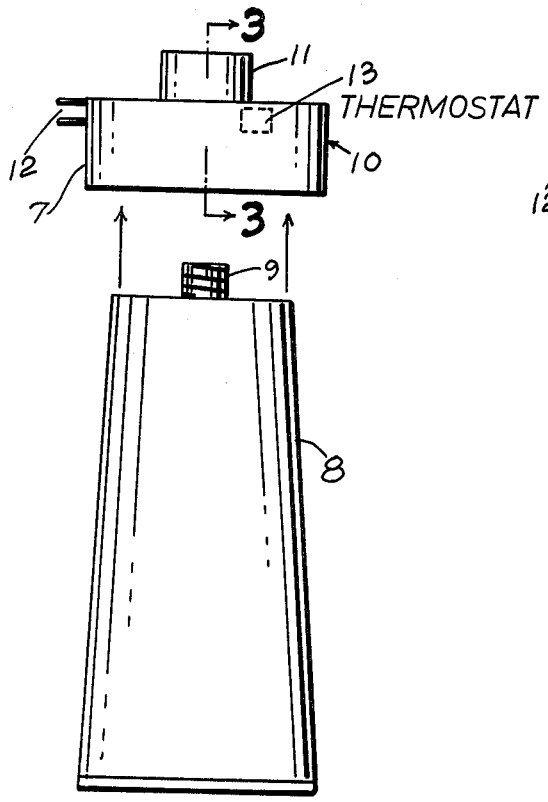
FIG. 1 is a front elevational view of a cap-shaped warmer at the upper end of a conventional tooth paste tube with the original cap removed, showing that the cap-shaped warmer is detachable to shield the outlet portion of the tooth paste tube as shown by two upward arrows between them.
Figure 3:
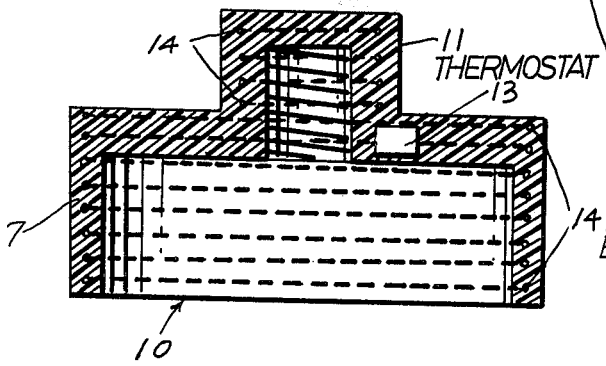
FIG. 3 is an enlarged, sectional view taken in the plane indicated by line 3—3 in FIG. 1, showing the heating element and thermostat molded in the wall of the cap-shaped warmer, the dotted lines indicating the electrical heating winding around the wall interior, and the heavy lines indicate screw threads at the protuberant portion inside.

Referring now to the drawings in detail, FIG. 1 illustrates a conventional tooth paste tube 8 having a threaded outlet 9 detachably shielded by a cap-shaped warmer 10 which has a protuberant portion 11. The two upward arrows between them indicate their attachment relation. The inside of the skirt 7 is equal in size to the outside of the tube 8 and is only for enveloping the outlet section of the tooth paste tube 8. The inside of the protuberant portion 11 is threaded, as shown in FIG. 3, and engages the outlet 9 of the tube 8 for attaching. The cap-shaped warmer 10 has an electrical plug 12 outside, a thermostat unit 13 and electrical heating elements 14 at the interior; they are connected in a series circuit. The electrical heating elements 14 are in coil configuration, with a small coil at the inside of the protuberant portion 11 and a larger coil at the skirt portion outlet end section of the cap-shaped warmer 10. However, the cap assembly may be made of plastic with the heating element embedded in the plastic during the molding operation.

When the electrical plug 12 is inserted in a power socket, electric power passes through the thermostat unit 13 to the electrical heating elements 14, and the tooth paste inside of the tooth paste tube 8 is warmed up. When it has warmed up to a preset temperature, the thermostat unit 13 opens and the electric power is interrupted to the heating elements 14. As the internal temperature drops below the preset limit, the thermostat unit 13 is closed and conducting again. Therefore, the outlet section of the tooth paste tube 8 is warmed and maintained at a desired temperature as long as the electrical plug 12 is connected to a power socket.

Figure 2:
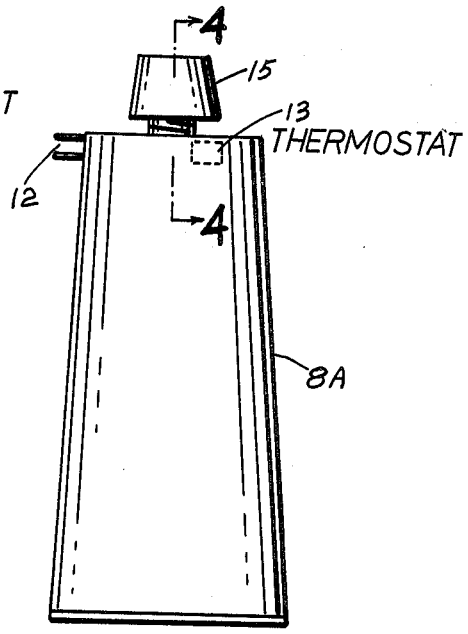
FIG. 2 is a front elevational view of a tooth paste tube having an electrical heating device at its outlet section.
Figure 4:
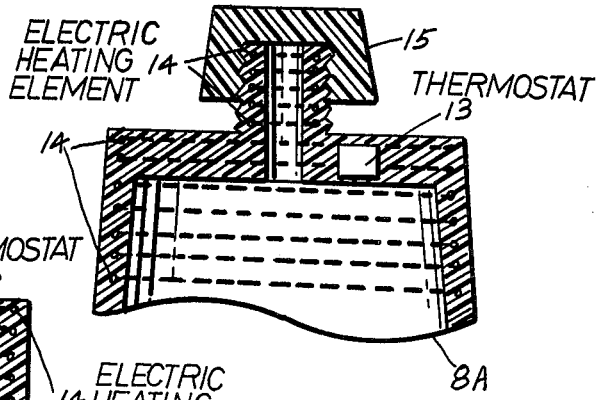
FIG. 4 is an enlarged, fragmentary sectional view taken in the plane indicated by line 4—4 in FIG. 2, showing the electrical heating element and thermostat molded around the tube wall and outlet fitting wall, the dotted lines indicating the electrical heating winding around the outlet section interior, with the inside tooth paste omitted for viewing clarity.
Figure 1:
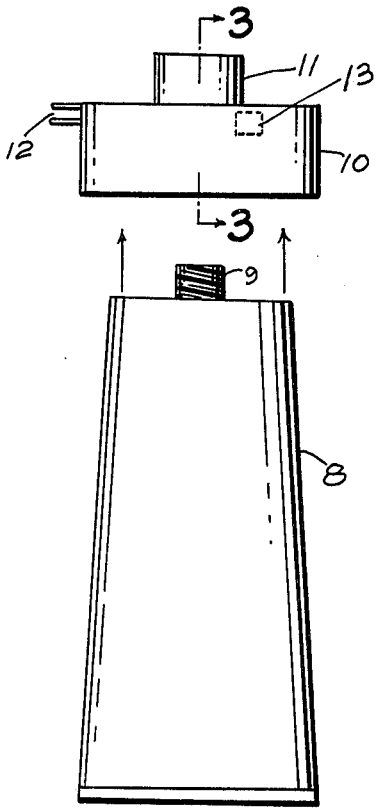
Figure 2:
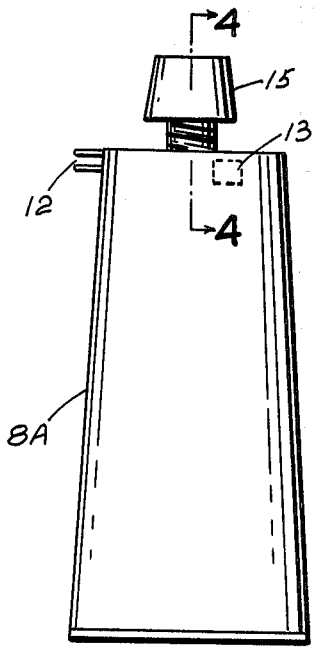
Figure 4:
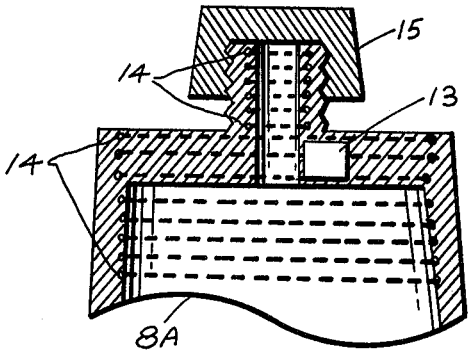
Figure 3:
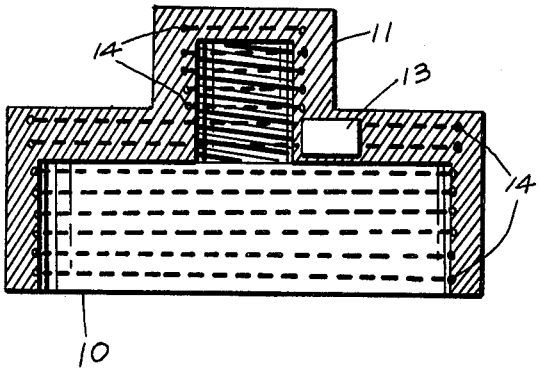
Figure 5:
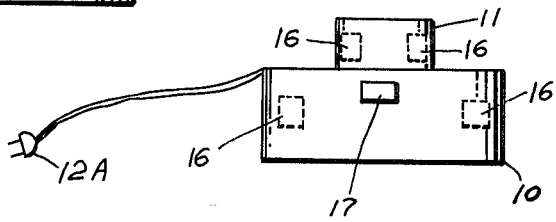

Since the electrical heating wire is not expensive and the installation is simple, the electrical heating device can be directly installed at the tooth paste tube either on the inside or the outside. For a tooth paste tube made of plastic material, the heating element set can be molded together during manufacture of the tube. For a tube made of metal, the heating element can be wound around the metal tube and sealed with some kind of insulating material. As shown in FIGS. 2 and 4, the electrical plug 12, thermostat unit 13 and electrical heating element 14, are connected in series circuit and directly installed in the outlet section of the tooth paste tube 8A. The tube 8A has a conventional cap 15. The electrical heating element assembly may be in a sleeve configuration and is installed in a metal tooth paste tube by means of molded plastic material or the like.

The area for installing electrical plug 12 is a thicker layer and is strong enough for pushing and pulling. In addition to the connecting power source, the electrical plug is also used for hanging purposes, to hang the tooth paste tube assembly on a wall electrical socket for continuously warming up.

The electrical heating wiring of FIGS. 1-4 for this warm up purpose is a kind of high resistance wire, and takes low current. Moreover, the resistance of the electrical wiring will increase as temperature increases, and so the current flow will decrease in the circuit as it heats, so that it will automatically limit the temperature to a maximum. Therefore, for simplification, the thermostat unit 13 can also be omitted.

A screw thread attachment of the cap-shaped warmer 10 to the tube outlet 9 is shown by way of example only, but any means known to the art may be used to detachably secure the cap-shaped warmer to the top of the tube.

It is to be understood that what has been described is merely illustrative of the principles of the invention and that numerous arrangements in accordance with this invention may be devised by one skilled in the art without departing from the spirit and scope thereof.

What is claimed is:

1. An apparatus for prewarming the tooth paste in a tooth paste tube before it is extruded from the tube through an opening in the end of the tube, said apparatus comprising:

a cap-shaped member closing said opening and enveloping the outlet end of said tooth tube, the cap-shaped member having an outer skirt portion extending along and surrounding a portion of the tubular side wall of the tube;

an electrical heating element insulated and molded in said cap-shaped member including said outer skirt portion surrounding the side wall of the tube with exterior electrical terminals to the heating element extending on the outside; and connecting means on said cap-shaped member for detachably holding the cap-shaped member on and enclosing the outlet end of said tooth paste tube, whereby the tooth paste in the outlet section of said tooth paste tube is warmed up when the exterior electrical terminals of said electrical heating element are connected to an electrical power source while the tube is closed by the cap-shaped member.

2. The apparatus set forth in claim 1 wherein a thermostat unit embedded in the cap-shaped member is connected in series circuit with the heating element to open or close the series circuit as the temperature of the cap-shaped member is above or below a desired temperature limit, respectively.

3. The apparatus set forth in claim 1 wherein said electrical terminals are formed in a rigid electrical plug at a stiff area on said cap-shaped member for directly inserting into a wall power socket as well as for hanging the assembly thereby.

4. The apparatus set forth in claim 1 wherein said connecting means includes the interior of said cap-shaped member having screw threads which engage with corresponding threads on the outlet end of said tooth paste tube.

* * * * *